US008307983B2

(12) United States Patent
Ludwig et al.

(10) Patent No.: US 8,307,983 B2
(45) Date of Patent: Nov. 13, 2012

(54) NON-RECLOSABLE PACKAGE FOR PRODUCTS PREJUDICIAL TO HEALTH, AS WELL AS PROCESS FOR ITS PRODUCTION

(75) Inventors: Karin Ludwig, Datzeroth (DE); Michael Horstmann, Neuwied (DE)

(73) Assignee: LTS Lohmann Therapie-Systeme AG, Andernach (DE)

( * ) Notice: Subject to any disclaimer, the term of this patent is extended or adjusted under 35 U.S.C. 154(b) by 0 days.

(21) Appl. No.: 11/664,243

(22) PCT Filed: Oct. 9, 2005

(86) PCT No.: PCT/EP2005/009748

§ 371 (c)(1),
(2), (4) Date: Mar. 30, 2007

(87) PCT Pub. No.: WO2006/037425

PCT Pub. Date: Apr. 13, 2006

(65) Prior Publication Data

US 2008/0105582 A1 May 8, 2008

(30) Foreign Application Priority Data

Sep. 30, 2004 (DE) ..... 10 2004 047 445

(51) Int. Cl.
*B65D 83/04* (2006.01)

(52) U.S. Cl. ..... 206/532; 206/538; 206/484

(58) Field of Classification Search ..... 206/528, 206/530, 438, 484, 813, 824, 532, 466, 469; 383/37, 200, 207, 208, 209, 38, 210, 210.1; 222/541.6

See application file for complete search history.

(56) References Cited

U.S. PATENT DOCUMENTS

| | | | | | |
|---|---|---|---|---|---|
| 2,245,738 | A | * | 6/1941 | Taylor | 383/209 |
| 2,923,404 | A | * | 2/1960 | Adell | 206/525 |
| D193,811 | S | * | 10/1962 | Ebert et al. | D9/707 |
| 3,224,640 | A | * | 12/1965 | Schneider et al. | 222/107 |
| 3,768,725 | A | * | 10/1973 | Pilaro | 383/200 |
| 3,809,220 | A | * | 5/1974 | Arcudi | 206/484 |
| 3,941,248 | A | * | 3/1976 | Moser et al. | 206/531 |
| 3,986,640 | A | * | 10/1976 | Redmond | 222/92 |
| 4,243,144 | A | * | 1/1981 | Margulies | 206/532 |

(Continued)

FOREIGN PATENT DOCUMENTS

DE 4109605 9/1992

(Continued)

*Primary Examiner* — Andrew Perreault
(74) *Attorney, Agent, or Firm* — D. Peter Hochberg; Sean F. Mellino; Daniel J. Smola

(57) ABSTRACT

A non-reclosable package for products which are prejudicial to health, such as pharmaceutical products. The package comprises a first packaging material element and a second packaging material element. The two packaging material elements are arranged on top of each other. The package has at least one first surface section, at the margin or margins of which the two packaging material elements are releasably connected with each other. At least one cavity, which is enclosed on all sides and receives the product to be packaged, is formed between the two packaging material elements. The package has at least one second surface section lying outside or adjoining the first surface section, and at the margin or margins of which the two packaging material elements are releasably connected with each other. At least one of the two packaging material elements has at least one structure extending within the second surface section and enables the packaging material element(s) to be torn.

46 Claims, 5 Drawing Sheets

U.S. PATENT DOCUMENTS

| | | | | |
|---|---|---|---|---|
| 4,398,634 | A * | 8/1983 | McClosky | 206/532 |
| 4,903,841 | A * | 2/1990 | Ohsima et al. | 383/200 |
| 5,005,734 | A * | 4/1991 | Van Gordon et al. | 222/107 |
| 5,242,433 | A * | 9/1993 | Smith et al. | 604/289 |
| 5,287,961 | A * | 2/1994 | Herran | 206/219 |
| 5,368,581 | A * | 11/1994 | Smith et al. | 604/290 |
| 5,445,454 | A | 8/1995 | Barkhorn | |
| 5,878,549 | A * | 3/1999 | Littmann et al. | 53/412 |
| 5,881,869 | A * | 3/1999 | Hudson | 383/206 |
| 5,938,032 | A * | 8/1999 | Svec et al. | 206/532 |
| 6,199,698 | B1 * | 3/2001 | Hetrick et al. | 206/532 |
| 6,296,389 | B1 * | 10/2001 | Yamamoto et al. | 383/210 |
| 6,360,916 | B1 * | 3/2002 | Sokolsky et al. | 222/107 |
| 6,471,401 | B1 * | 10/2002 | Tokita | 383/208 |
| 6,520,329 | B1 | 2/2003 | Fuchs et al. | |
| 6,568,533 | B1 * | 5/2003 | Tanaka et al. | 206/484 |
| 6,789,945 | B2 * | 9/2004 | Mobs et al. | 383/37 |
| 6,945,391 | B2 * | 9/2005 | Moodie | 206/824 |
| 6,968,952 | B2 * | 11/2005 | Crevier et al. | 206/484 |
| 7,607,834 | B2 * | 10/2009 | Alvater et al. | 383/210 |
| 7,757,855 | B2 * | 7/2010 | Jarvis et al. | 206/524.1 |
| 2003/0085298 | A1 * | 5/2003 | Schuehrer et al. | 239/34 |
| 2003/0089625 | A1 * | 5/2003 | Moodie | 206/204 |
| 2005/0045497 | A1 * | 3/2005 | Sample | 206/69 |
| 2006/0200098 | A1 | 9/2006 | von Falkenhausen | |
| 2007/0205127 | A1 * | 9/2007 | Barndt et al. | 206/484 |
| 2008/0190809 | A1 * | 8/2008 | Simon et al. | 206/532 |

FOREIGN PATENT DOCUMENTS

| | | |
|---|---|---|
| DE | 19706825 | 9/1998 |
| DE | 19856845 | 6/2000 |
| DE | 202004003781 | 5/2004 |
| DE | 10307583 | 9/2004 |
| EP | 0671432 | 9/1995 |
| EP | 1120355 | 8/2001 |

* cited by examiner

NON-RECLOSABLE PACKAGE FOR PRODUCTS PREJUDICIAL TO HEALTH, AS WELL AS PROCESS FOR ITS PRODUCTION

CROSS-REFERENCE TO RELATED APPLICATIONS

This application is a National Stage application of International Application No. PCT/EP2005/009748, filed on Sep. 10, 2005, which claims priority of German application number 10 2004 047 445.1, filed on Sep. 30, 2004.

BACKGROUND OF THE INVENTION

1. Field of the Invention

The invention relates to non-reclosable packages for products prejudicial to health, especially for pharmaceutical products. The invention further relates to processes for the production of such packages and for the packaging of products by such packages.

2. Description of the Prior Art

Increased demands are made on the safety of packages which are used for packaging products that are potentially detrimental to health, in order to prevent unauthorized removal of the products or to prevent any use thereof which is not as intended. Particularly in the packaging of medicaments it must be ensured by appropriate measures that the packaged product cannot be removed from the package by children. To this end, child-resistant packages of various types have been developed, and international standardised testing procedures have been introduced to test child-resistance (DIN EN 862, relating to non-reclosable packages for non-pharmaceutical products; DIN EN 14375, relating to non-reclosable packages for pharmaceutical products).

On the other hand, a child-resistant design must not lead to authorized opening of the package and to opening which is in accordance with the designated use being made unreasonably difficult. A child-resistant medicament package must be conditioned such that, for example, elderly people too are capable of opening the package by themselves and within a few minutes.

SUMMARY OF THE INVENTION

The packages of the present invention are non-reclosable packages with at least one releasable connection (e.g. a sealed seam). Opening takes place in such a manner that one or more releasable connections are released manually, without the aid of auxiliary means or tools, by pulling apart, thereby making the packaged product accessible so that it can be removed through the resultant opening.

The object of the present invention is to provide a package of the aforementioned type which is suitable for the packaging of products which are potentially prejudicial to health, and which, in particular, is suitable as a child-resistant package, and which in a simple manner enables handling as intended.

This object is achieved by means of a non-reclosable package having a pair of packaging material elements lying on top of each other and releasably connected to each other at a margin of a first surface section of the package to form at least one cavity for receiving a product. The package has a second unsealed surface section lying outside of the first surface section with a margin to which the pair of packaging elements are releasably connected, the package further including at least one structure provided with at least one of the packaging material elements and extending within an at least one second surface section for enabling the tearing of the packaging material elements. The object is further achieved by the use of the foregoing package for packaging pharmaceutical and cosmetic preparations, or other objects or substances which are prejudicial to health and/or to make the package child-resistant. The object is further achieved by the process of production and packaging for the package described above.

A non-reclosable package for products which are prejudicial to health, particularly pharmaceutical products, according to the invention comprises a first packaging material element and a second packaging material element, with the two packaging material elements being arranged so as to lie on top of each other. The package furthermore has at least one first surface section at the margin or margins of which the two packaging material elements are releasably connected with each other, whereby at least one cavity which is enclosed on all sides and serves to receive the product to be packaged is formed between the two packaging material elements. The package furthermore has at least one second surface section which lies outside the said first surface section or adjoins the latter, and at the margin or margins of which the two packaging material elements are releasably connected with each other. At least one of the two packaging material elements is provided with at least one structure which extends within the second surface section (12) and enables partial tearing of the packaging material element(s).

Opening of the package generally takes place in such a way that one of the two packaging material elements, or both of them, is/are torn within the second surface section by using the force of ones fingers, beginning at the structure. This produces two freely accessible margins of the packaging material elements which can serve as gripping aids or gripping tabs to separate the releasable connections between the two packaging material elements. Finally, the releasable connections in the first surface section are also released thereby, thus making the cavity containing the packaged product accessible.

Due to these features of the present invention, it is possible to design the package such that opening thereof is only possible through an ordered sequence of at least four steps:

(i) folding or doubling the package along a line, making the structure accessible for tearing;

(ii) partially tearing the package at the place provided with the structure and continuing to tear along the structure;

(iii) gripping the now exposed edges of the packaging material elements as gripping aids (tear tabs), and (iv) pulling apart and releasing the connections between the packaging material elements.

This handling poses considerable problems for children, especially for infants, but adults can perform it without difficulty and without the aid of tools.

Generally, the packaging materials used for producing the packaging material elements must exhibit a tear strength which is sufficient to ensure that the package, in undamaged condition, cannot be destroyed without the aid of auxiliary means, e.g. tools. Packaging materials suitable for this purpose are known to those skilled in the art; for example, film-like, flexible materials of plastic or metal (e.g. aluminium), or composites of the materials mentioned may be utilised. Both mono-films and two- or multilayered laminates may be used as film-like materials. As plastic materials, the following are, in particular, taken into consideration, either singly or in combination: polyester (e.g. polyethylene terephthalate), polyethylene (e.g. HDPE; LDPE), polypropylene, polyisobutylene, polystyrene, polyvinyl chloride, polyamide, polycarbonate, and cellulose acetate. The thickness of the film-shaped materials is preferably in the range of 5 to 300μm, especially preferably of 50 to 200 μm.

A further, preferred, film-material is BAREX® (BP Chemicals), a copolymer of acrylonitrile and butadiene.

BAREX® can be obtained by graft polymerisation from 73-77 parts acrylonitrile and 23-27 parts methyl acrylate in the presence of 8-18 parts of a butadiene-acrylonitrile copolymer which contains a portion of around 70% butadiene.

BAREX® is the sealable part of a packaging material composite. It is a material of an extraordinarily high chemical inertness and represents an excellent oxygen barrier. It does, however, have a certain degree of permeability to water vapour.

Because of its good barrier properties and chemical resistance, BAREX® is particularly suitable for packaging medicaments containing aggressive and/or volatile active substances, e.g. nicotine.

The two packaging material elements may be produced from the same materials or from different materials. Preferably at least one of the two packaging material elements consists of transparent material (e.g. transparent plastic film).

The invention further comprises embodiments wherein one packaging material element or both packaging material elements are coloured in the same or different colours, with the respective colourings possibly being transparent or opaque.

For example, one of the two packaging material elements may be produced from a non-transparent composite material of paper (or cardboard) with plastics (e.g. polyethylene-coated or polyethylene terephthalate-coated papers) and the second packaging material element may be produced from a transparent, colourless or coloured plastic film. To reduce the permeability to air, light and water vapour, it is advantageous that at least one surface of the carrier layer or/and of the cover layer be metallized (e.g. coated with aluminium).

The above-mentioned releasable connections are preferably formed by sealed seams or sealed areas. In particular, peelable film lacquers (peel lacquer) or hot melt adhesives may be used as a sealing medium. Suitable sealing compounds and sealing processes are known to the skilled artisan, e.g. sealing compounds based on polyethylene LD or ethylene-vinyl acetate copolymers. Both heat-sealing methods and cold-sealing methods are suitable.

Preferably, the peelable connection is formed by heat-sealing at temperatures in the range between 50° C. and 250° C., especially 50 to 200° C., with the use of hotmelts.

The sealed seams or sealed areas preferably have a width of 0.1 mm to 10 cm, especially 1 mm to 2 cm, and they preferably extend over the entire length or width of the packaging material elements. To make opening of the package even more difficult, at least one of the sealed seams may be configured so as to be of a larger width than the remaining sealed seams.

The sealed seams or sealed areas are preferably of a strength (i.e., seal strength) in the range from 1 N/15 mm to 50 N/15 mm, preferably 2 N/15 mm to 20 N/15 mm.

The above-mentioned structure for enabling initial tearing of the packaging material elements may be present in one of the two packaging material elements or in both of them, the latter embodiment being preferred. In the latter case, the structure(s) are preferably adapted to be alike or similar, and congruent to each other, in both packaging material elements.

The following are preferably suitable as the structures enabling initial tearing of the packaging material element(s): straight cuts; jagged or undulated cuts; perforations, especially perforations consisting of dots and/or cuts arranged one after another; recesses in the material; punchings, especially arrow-shaped, triangular or rhombic punchings; predetermined breaking points.

The structure(s) is/are preferably located marginally within the second surface section, i.e. in the vicinity of the margin (e.g. sealed seam or sealed area) connecting the two packaging material elements, but not within the margin. The invention, however, also encompasses other embodiments wherein the structure extends partially into the sealed margin area. However, by no means may the tear-structure run up to the outer edge of the package.

To facilitate the above-mentioned process of folding or creasing the package, it is advantageous to provide the package with a crease line or fold line, for example by embossing or squeezing. Methods suitable for this purpose are known to those skilled in the art.

The structure, or at least one of the structures, is preferably arranged such that—starting from the interior area of the second surface section—it intersects the crease line or fold line, for example at a right angle or at an oblique angle, so that the structure extends on both sides of the crease or fold line. The tear structure should, however, at least reach the crease line or fold line and touch the same.

By designing the tear structure in such a manner that it intersects the crease or fold line as described above, the process of tearing is considerably facilitated, without interfering with the child resistance of the package.

This is significant particularly with regard to the designated use of the package by elderly persons as in that case, too, it has to be ensured that the package can be opened without the aid of tools or other auxiliary means and that opening is possible within a short period and without frustrating attempts.

According to a further embodiment, at least the first packaging material element is formed of a mono-layered or multilayered film, and that this packaging material element is provided with one or more of the structures. The second packaging material element releasably connected with the film may in this case be made of a different material (e.g. a plastic moulded part).

According to a preferred embodiment, the packaging according to the invention is configured as a bag which is closed all around and which is preferably flat.

It is furthermore preferred that the two packaging material elements be connected along the entire outer edge of the package by an uninterrupted sealed layer or sealed seam.

According to a further embodiment it is provided that the second packaging material element is configured as an open container, an open hollow body, especially a bottle, or a deep-drawn moulded part, depending on the shape and size of the product to be packaged. In this case, too, the second packaging element has a second surface section, as described above. In particular, it is possible to use a thermoformed blister film as the second packaging material element; such films are known to the skilled artisan (e.g. rigid PVC films, cellulose ester films or oriented polystyrene films; in each case of a thickness of 50 to 2000 μm, especially preferably 100 to 1000 μm).

The base area of the packages may have a variety of sizes and shapes—depending on the size and shape of the products to be packaged; the preferred shape is rectangular or square. The package may also have a circular, elliptical, or an irregular shape. Preferably, the margins of the package are releasably connected with each other at at least two, preferably at least three edges. Furthermore, the said two surface sections of the package may be adapted to be of the same or of a different size. The cavity for receiving the product to be packaged may be divided into several compartments; likewise, two or more cavities for receiving goods to be packaged may be provided in each package.

According to a further embodiment, the two packaging material elements are made of the same material. Both packaging material elements may, for example, be made of transparent or non-transparent material.

A further embodiment provides that the two packaging material elements are made of different materials. For example, one of the elements may be formed from transparent material and the other one from non-transparent material.

Preferably, at least one of the two packaging material elements, preferably the first one, has high tear strength and at the same time low tear propagation strength. In this way it is possible to achieve high protection against unauthorised opening, and facilitation of handling in the case of opening as intended.

To enable or facilitate that the structure is torn further, it is preferred that the tear strength be a multiple of the tear propagation strength. Preferably, the ratio of tear strength and tear propagation strength is in the range from 2 to 200, especially in the range from 50 to 150. The values indicated relate to the tear strength and tear propagation strength of the two packaging material elements connected with each other.

Tear strength and tear propagation strength can be determined by known tensile testing machines (e.g. available from FRANK Prüfgerate GmbH, D-69488 Birkenau). In such measurements, a tear strength of 70 N and a tear propagation strength of 0.5 N was determined. For example, in another case, the tear strength was 95 N and the tear propagation strength 1.5 N, measured in each case at the two packaging material elements which are connected with each other and which form the package. The measurements were made on a tensile testing machine of the firm of FRANK by using a sample holder for tear tests (type No. 00740).

On the other hand, care must be taken to ensure that the tear strength is not too low as this would no longer guarantee sufficient protection of the packaged goods, and as there is a risk of the said gripping aids being torn off when opening the package. This can be established by simple tests.

Materials which possess the above-mentioned properties (tear strength, tear propagation strength) are known to the skilled artisan. Polyester films are particularly suitable.

Especially preferred are packaging materials, especially plastic films, whose tear propagation strength in the longitudinal direction differs from that in the transverse direction. The structures enabling initial tearing and tear propagation of the packaging material elements are preferably provided along that direction of the film in which the tear propagation strength is lowest. Depending on the desired design of the package and of the manufacturing plant, the aids for tearing and tear propagation may also be provided in a direction different from that described above.

In particular, for this purpose, it is possible to use plastic films that have been stretched only in one direction, or have been stretched to a greater extent in the longitudinal direction than in the transverse direction or vice versa. Films treated in this manner, e.g. polyester films, polystyrene films, polyamide films, polyethylene films or polycarbonate films, are known to those skilled in the art. In this way, tearing of the packaging material which is as intended is facilitated without impairing the mechanical stability of the gripping tabs.

The goods packaged inside the packages according to the present invention are therefore not accessible to children without the use of tools. According to an especially preferred embodiment, the packages are child-resistant according to DIN EN 14375 and/or according to ASTM D3475-03a.

The package according to the invention may be in the form of a single package; however, it is also provided that two or more such packages are combined to form a packaging unit, e.g. in the form of a strip or a card. These packages, which are connected with one another, may preferably be present in rolled-up form or folded in the manner of an accordion. Perforation lines may be provided between the individual packages to enable separation of an individual package. For example, about 50 to 500 of such packages may be rolled up, in the form of a dispenser roll, around a winding core. Each of the packages which are connected with and can be separated from one another contains a single dose of a pharmaceutical active substance, and each one of these packages possesses the features of a child-resistant package, as described above.

Furthermore, two or more individual packages may also be connected with one another in a radial-symmetric arrangement, whereby a package unit in the form of a dispenser disc is formed, from which the individual packages can be separated one after the other. In this case, too, each of the packages which are connected with and separable from one another contains a single dose of an active substance, and each one of these packages possesses the features of a child-resistant package, as described hereinabove.

Preferably, the package units described hereinabove are used together with dispensing devices which are suitable for this purpose and which enable or facilitate separation and removal of the individual packages.

The invention further encompasses the use of the above-described packages for packaging pharmaceutical or cosmetic preparations, or for packaging objects or substances prejudicial to health, preferably for child-resistant packaging of the preparations or objects.

The process according to the present invention for the production of a package and for the packaging of objects has the following steps:

- providing a first packaging material element;
- providing a second packaging material element;
- positioning the product to be packaged on one of the two packaging material elements;
- superimposing and connecting the two packaging material elements in such a manner that at least one first surface section is formed, at the margin or margins of which the two packaging material elements are releasably connected with each other, and whereby at least one cavity is formed between the two packaging material elements which is enclosed on all sides and serves to receive the product to be packaged, and in such a manner that at least one second surface section is formed which lies outside the first surface section or adjoins the latter, and at the margin or margins of which the two packaging material elements are releasably connected to one another; and
- providing at least one structure in at least one of the two packaging material elements, the structure extending within the second surface section and enabling initial tearing of the packaging material element(s).

The above-indicated sequence of the process steps is not obligatory. For example, the structure may be provided already after the first or second of the above-indicated steps.

It is likewise not necessary that the first packaging material element and the second packaging material element be formed from different packaging material webs. Thus, by folding a single packaging material web it is possible to provide two packaging material elements between which the products to be packaged can be positioned.

Preferred embodiments of the package according to the invention are three-side-sealed bags and four-side-sealed bags.

BRIEF DESCRIPTION OF THE DRAWINGS

In the following, the features, details and advantages of the invention will be explained, by way of example, by means of the embodiments schematically represented in the drawings.

DETAILED DESCRIPTION OF THE INVENTION

Figure 1:
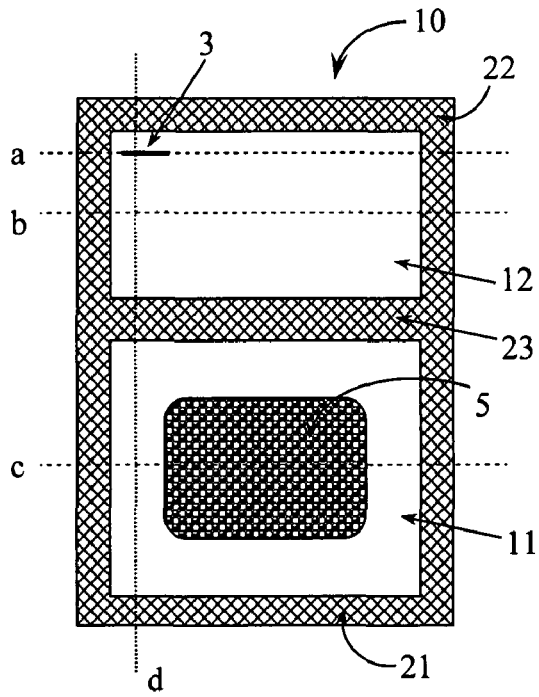
FIG. 1 is a plan view of a package according to the present invention.

FIG. 1 shows a package (10) which—as can be seen from the cross-sections shown in FIGS. 2 to 7—is formed from a first packaging material element (1) and a second packaging material element (2). The package has a first surface section (11), at the margin (21) of which the two packaging material elements (1, 2) are releasably connected with each other; see also FIGS. 7 and 8. Within this first surface section, a cavity (4) for receiving the product (5) to be packaged is formed by the two superimposed packaging material elements (see also FIGS. 7 and 8). The package (10) has a second surface section (12) which is outside first surface section (11) and is adjacent to first surface section 11, and at the margin or margins (22) of which the two packaging material elements (1, 2) are releasably connected with each other (see also FIG. 2 to FIG. 5), such as by a sealed area or sealed seam. This surface section (12) is formed in a simple manner by projecting packaging material (1, 2) of the first surface section 11.

A partition 23 is provided between the first (11) and the second (12) surface section, wherein the two packaging material elements 1, 2 are likewise connected to each other. Within the second surface section (12), the package is provided with at least one structure (3)—here in the form of a cut—that enables initial tearing of the packaging material elements (1, 2).

The structure(s) (3) may be provided in the direction of line (a) as shown in FIG. 1; however, structures 3 may also be provided perpendicular to the direction of line (a), i.e. in the direction of line (d), or in an oblique direction.

The length and width of the structure (3) as well as its relative position within the surface of the package may be varied so as to deviate from the example shown in FIG. 1.

In the case of the embodiment shown in FIG. 1, to open package 10; package 10 is folded roughly along line (d). The structure (3) intersects this line at right angles and extends on both sides of the fold line (d).

Figure 2:
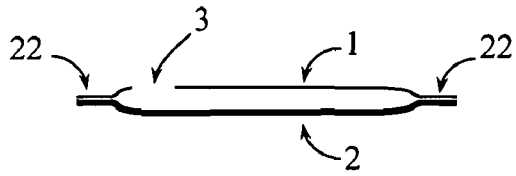
FIG. 2 is a cross-sectional view of the package as shown in FIG. 1 in plane (a) of FIG. 1.

As can be seen from FIG. 2, the two packaging material elements (1, 2) are, in the region of the second surface section (12), connected with each other at the respective margins (22). The structure (3) is located within the first packaging material element (1), in immediate vicinity to the sealed margin (22).

Figure 3:
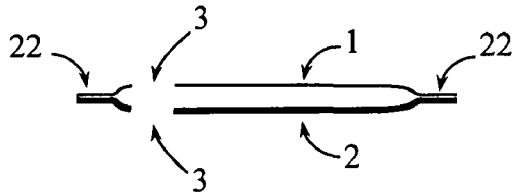
FIG. 3 is a cross-sectional view of an alternative embodiment of the package as shown in FIG. 2.

FIG. 3 shows an alternative embodiment of the package shown in FIG. 1, with the structure (3)—here in the form of a cut—being provided both in the first packaging material element (1) and in the second packaging material element (2), both cuts 3 being of the same length and located at the same position.

Figure 4:
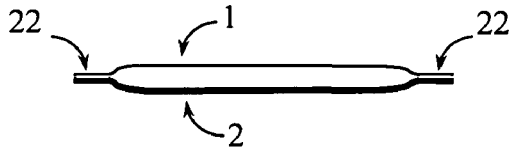
FIG. 4 is a cross-sectional view of the package as shown in FIG. 1 in plane (b) of FIG. 1.

As can be seen from FIG. 3 and FIG. 4, the two packaging material elements 1, 2 are, in this case, made of materials of different thickness.

Figure 5:
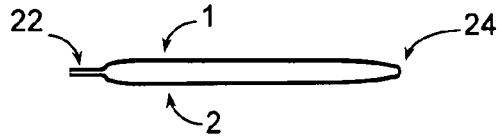
FIG. 5 is a cross-sectional view of an alternative embodiment of the package as shown in FIG. 4.

FIG. 5 shows an alternative embodiment of the package 10 represented in FIG. 1, wherein the first packaging material element (1) and the second packaging material element (2) are formed from a single web of material, e.g. from a film-shaped material, by folding the film-shaped material at a fold (24) and releasably connecting it at the margin (22), e.g. by a sealed seam.

Figure 6:
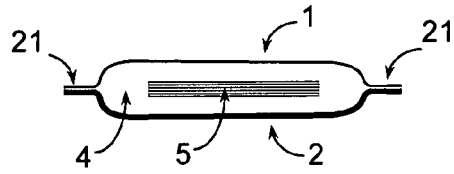
FIG. 6 is a cross-sectional view of the package as shown in FIG. 1 in plane (c) of FIG. 1.

FIG. 6 shows a packaged product (5) enclosed in the cavity (4) of the package 10. The first packaging material element 1 is releasably connected with the second packaging material element (2) at the margins or sealed seams (21).

Figure 7:
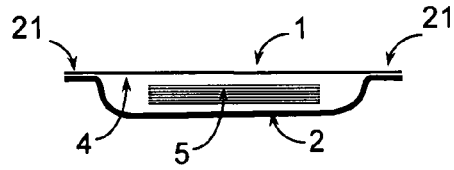
FIG. 7 is a cross-sectional view of an alternative embodiment of the package as shown in FIG. 6.

FIG. 7 shows an alternative embodiment of the package 10 represented in FIG. 1, wherein a deep-drawn moulded part is used as the second packaging material element (2). Optionally, the first packaging material elements (1) may be a deep-drawn moulded part, or both packaging material elements (1, 2) may be deep-drawn moulded parts.

Figure 8:
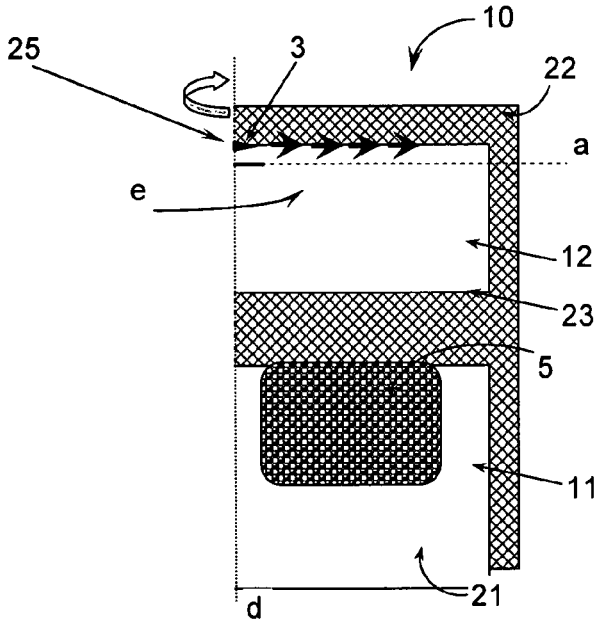
FIG. 8 is a plan view of the package of the present invention as shown in FIG. 1, and represents the package while it is being torn open.
Figure 9:
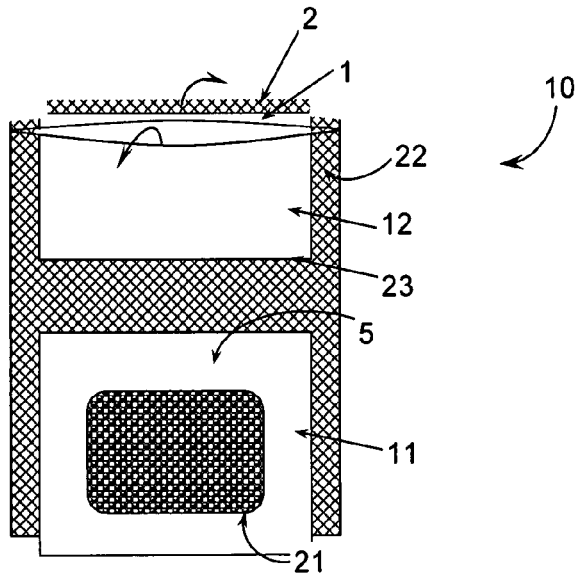
FIG. 9 is a plan view of the opening process of the package of the present invention as shown in FIG. 8.

FIGS. 8 and 9 illustrate the procedure of opening, in accordance with the designated use, of the package 10 depicted in FIG. 1. To this end, the package 10 is first folded along line (d), as indicated by the semicircular arrow. Line (d) extends crosswise (i.e. almost perpendicular) to the direction of the structure (3) (line (a) in FIG. 1), which is provided in the form of a cut and which is present in both packaging material elements (1, 2). If the structure (3) extends in another direction than the one shown in FIG. 1, the fold direction is in any case selected such that, if possible, the fold direction extends approximately perpendicular to the direction of the structure (s) (3) or in an oblique direction relative to structure 3.

By folding along line (d), an open notch (25) is formed in the region of the cut (3). Due to the small tear propagation strength of the material of the packaging material elements (1, 2), the cut (3) can be elongated by further tearing in the direction of arrows (e) shown in FIG. 8. Preferably, the tear propagation strength in direction (d) is larger than that in the direction of the tear structure (3), that is, in the direction of line (a) in FIG. 1.

In this manner, the sealed margin (22), which is located at the upper margin of the package of FIG. 8, can be largely or even entirely separated. This state is shown in FIG. 9. By separating the sealed margin, two exposed edges of the packaging material elements (1, 2) have been created which may serve as gripping aids or gripping tabs and which can be torn away from each other in the direction of the two arrows. In this manner, the two packaging material elements (1, 2) can be separated from each other completely or in any case up into the area of the packaged product (5), so that the latter becomes accessible and can be removed.

Figure 10:
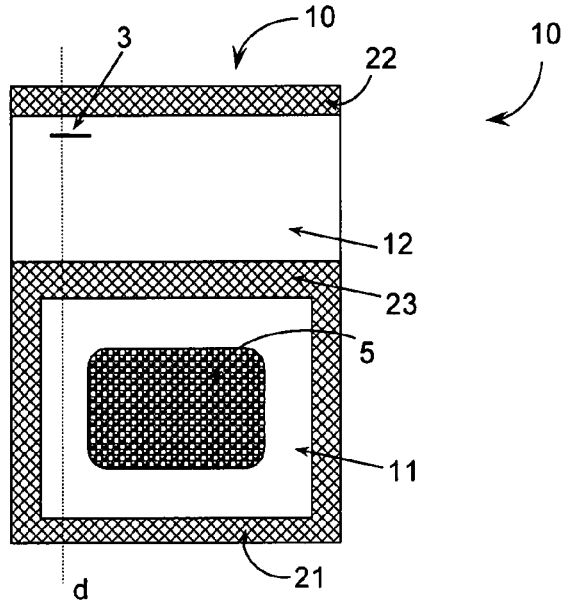
FIG. 10 is a plan view of a further embodiment of the package according to the invention.

FIG. 10 shows a further embodiment of the package according to the invention, wherein the packaging material elements (1, 2) are releasably connected to each other in the region of the second surface section (12) along an outer edge, by a sealed area or sealed seam (22). The sealed seam (22) is separated—as described above—so that the packaging material elements (1, 2) are no longer connected with each other in the surface section (12), but form individual gripping tabs by which the packaging material elements (1, 2) can be completely detached from one another.

Figure 11:
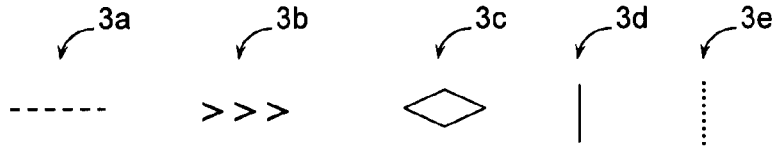
FIG. 11 is a plan view of different examples of tear structures for tearing open the package of the present invention.

FIG. 11 shows structures (3) in the form of a perforation (3*a*), in the form of a sequence of V-shaped punchings (3*b*) arranged one after another, and in the form of rhombic punchings (3*c*); all of which are arranged in the direction of line (a) shown in FIG. 1. FIG. 11 also shows structure (3) in the form of a cut (3*d*) or perforation (3*e*), each arranged in the direction of line (d) shown in FIG. 1. In the case of the structures (3*d*, 3*e*) the package is, upon opening, folded in the direction of line (a) shown in FIG. 1, for example (corresponding to the procedure according to FIGS. 8 and 9; see above).

Figure 12:
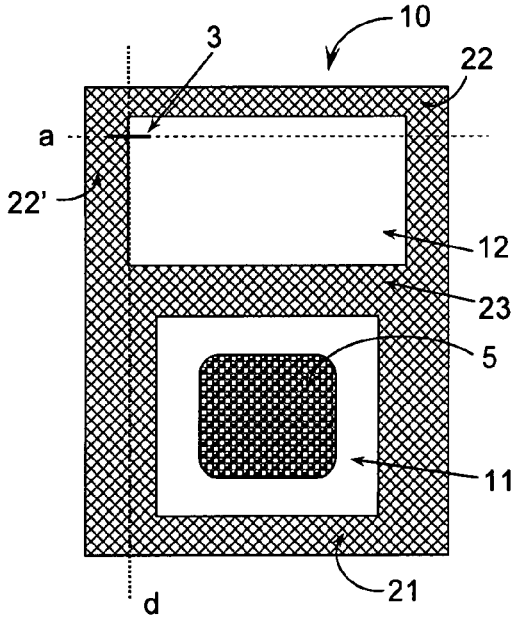
FIG. 12 is a plan view of a further embodiment of the package according to the invention.

FIG. 12 shows a modification of the embodiment represented in FIG. 1, wherein the crease line (d) runs along an outer edge of the second surface section (12), but within second surface section 12. The tear structure (3) intersects line (d) at right angles and extends from the interior of the second surface section (12) up into the sealed margin area (22'). By folding the package along crease line (d), the tear structure (3) is exposed and the package can be opened as described in FIG. 8.

Figure 13:
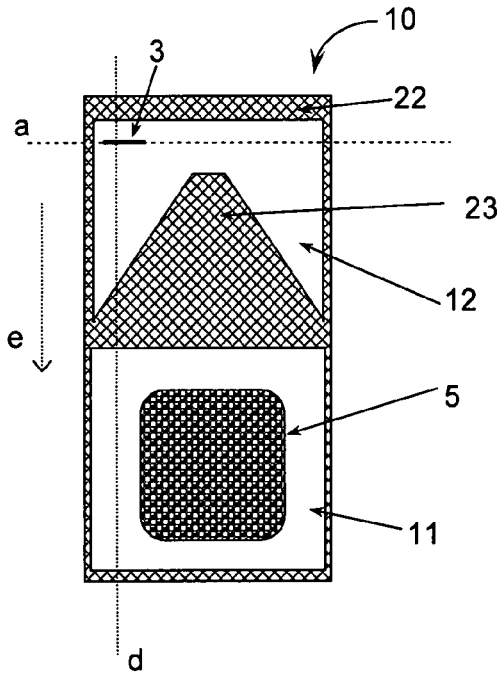
FIG. 13 is a plan view of another further embodiment of the package according to the invention.

FIG. 13 shows a modification of the embodiment shown in FIG. 1, wherein the partition (23) projects, in the form of a protrusion or a tongue, into the region of the second surface section (12). This protrusion may be in the shape of a trapezium—as shown—but the partition may also be round or have a convex curvature (e.g. in the shape of a segment of circle, or parabolic), or have the shape of a triangle. The protrusion may also—as shown—be axially symmetric; as an alternative, asymmetric or irregular geometric shapes are also possible.

Tearing open the package, i.e. detaching the two packaging material elements (1, 2) and tearing them away from each other, is thereby facilitated. Since the width of the partition (23), relative to the direction of tearing open (arrow e), is initially small and then gradually increases, tearing open can be performed with less expenditure of force as compared to the embodiments wherein the partition is of a constant width.

Figure 14:
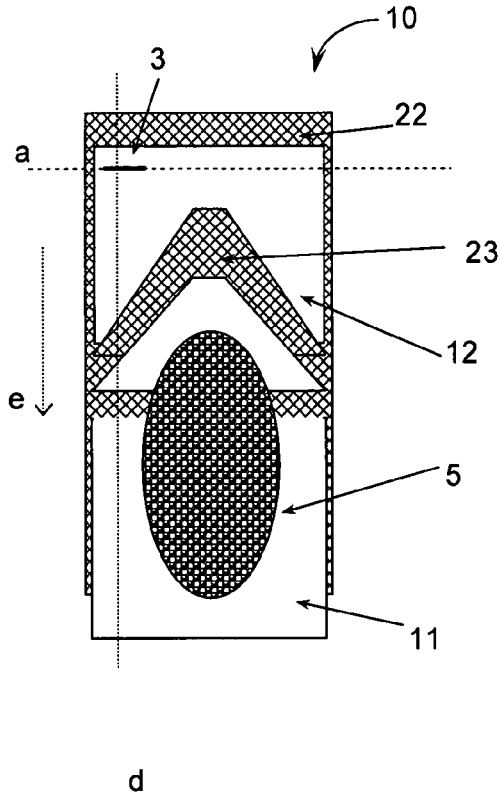
FIG. 14 is a plan view of a variant of the embodiment of the present invention shown in FIG. 13.

By designing the partition in this manner, it is also possible to reduce the total length of the package, or to increase the extent of the first surface section (11), thus creating an enlarged space (4) for receiving the product to be packaged (FIG. 14).

What has been described above are preferred aspects of the present invention. It is of course not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, combinations, modifications, and variations that fall within the spirit and scope of the appended claims.

The invention claimed is:

1. A non-reclosable package for products which are prejudicial to health, said package comprising:

a first packaging material element;

a second packaging material element, wherein said first and second packaging material elements are arranged so as to lie on top of each other; at least one first surface section having at least one margin, wherein said first and second packaging material elements are releasably connected with each other at said at least one margin of which of said at least one surface section for forming at least one cavity in said package wherein said at least one cavity is enclosed on all sides, receives the product to be packaged, and is formed between said first packaging material element and said second packaging material element;

at least one unsealed, second surface section which lies outside said at least one first surface section or adjoins said at least one first section, said at least one second surface section being delimited by at least one margin, wherein said first packaging material element and said second packaging material element are releasably connected with each other at said at least one margin of said at least one second surface section; and wherein at least one structure is present in at least one of said first packaging material element, said at least one structure being selected from the group of structures consisting of straight cuts, jagged cuts, undulated cuts, perforations, recesses in material, punchings and predetermined breaking points; and wherein said at least one structure extends within said at least one second surface section and enables said first packaging material element and said second packaging material element to be torn-open direction, and at least one crease line of fold line which at least partially extends within the second surface section or at and outer edge of said second surface section and extend through said first surface section or into the sealed margin area at or near said first surface section, and wherein said at least one structure intersects the crease line of fold line.

2. The package according to claim 1, further comprising sealed seams or sealed areas, wherein said sealed seams or sealed areas form said releasable connections between said first packaging material element and said second packaging material element.

3. The package according to claim 1 wherein said at Least one structure is provided in said first packaging material element and said second packaging material element, and wherein said at least one structure comprises multiple structures, said multiple structures being alike or similar, and are congruent to one another.

4. The package according to claim 1, wherein said at least one structure is arranged within said at least one second surface section near or at the margin, but not within the margin which connects said first packaging material element and said second packaging material element.

5. The package according to claim 1, further comprising a partition between the at least one first surface section and the at least one second surface section, said partition being in the region the wherein said first packaging material element and said second packaging material element are releasably connected with one another.

6. The package according to claim 5, wherein the width of the partition increases relative to the tear-open direction of the package in such a manner that the partition extends into said at least one second surface section in a configuration selected from the group consisting of a curvature, the tip of a triangle and in the shape of a trapezium.

7. The package according to claim 1, wherein at least the first packaging material element is formed from a monolayered or multilayered film, and wherein said first packaging material element is provided with said at least one structure.

8. The package according to claim 1, wherein said package is configured as a bag which is closed all around.

9. The package according to claim 1, wherein said second packaging material element is selected from the group consisting of containers, hollow bodies and deep-drawn moulded parts.

10. The package according to claim 1, wherein said package comprises rectangular or square surface shape, and wherein the margins are connected with one another at least at two edges by sealed seams.

11. The package according to claim 1, wherein at least one of the two packaging material elements has high tear strength and low tear propagation strength, wherein the ratio of tear strength to tear propagation strength is in the range from 2 to 200.

12. The package according to claim 1, wherein an uninterrupted sealed layer or sealed seam connects said first packaging material element and said second packaging material element along the entire outer margin of the package.

13. The package according to claim 1, wherein said perforations comprise at least one of dots and cuts arranged one after another, and said punchings are selected from the group consisting of arrow-shaped, triangular-shaped and rhombic-shaped punchings.

14. The package according to claim 1, wherein said at least one structure intersects the crease line or fold line at right angles.

15. The package according to claim 9, wherein said hollow bodies are bottles.

16. The package according to claim 10, wherein said margins are connected with one another by sealed seams at least at three edges.

17. The package according to claim 11, wherein said first packaging material element has high tear strength and low tear propagation strength, wherein the ratio of tear strength to tear propagation strength is in the range from 2 to 200.

18. The package according to claim 11, wherein the ratio of tear strength to tear propagation strength is in the range from 50 to 150.

19. The package according to claim 17, wherein the ratio of tear strength to tear propagation strength is in the range from 50 to 150.

20. The package according to claim 1, wherein said product received in said cavity is selected from the group consisting of pharmaceutical preparations and cosmetic preparations.

21. The package according to claim 1, wherein said product received in said cavity is a product that is potentially detrimental to health.

22. The package according to claim 1,wherein said first packaging material element and said second packaging material element, which are releasably connected with each other at said at least one margin of said at least one second surface section, form a void compartment.

23. The package according to claim 1,wherein said first packaging material element and said second packaging material element, which are releasably connected with each other at said at least one margin of said at least one second surface section, form a compartment which does not contain said product(s).

24. The package according to claim 1, wherein said crease line of fold line intersects said structure at a right angle.

25. The package according to claim 1, wherein said crease line or fold line intersects said structure at an oblique angle.

26. The package according to claim 1, wherein said structure extends on both sides of the crease line or fold line.

27. The package according to claim 1, wherein said package has an outer edge and said crease line or fold line runs parallel to the outer edge of the package.

28. The package according to claim 1, wherein said crease line or fold line is produced by embossing or squeezing.

29. The package according to claim 1, wherein said at least one structure has a length which extends only within a partial area of said second surface section.

30. The package according to claim 1, wherein at least one structure is arranged within said at least one second surface section near or at the margin, but not within the margin which connects said first packaging material element and said second packaging material element, and wherein the length of said at least one structure is shorter than the distance between said margin and an opposite margin of said second surface section.

31. The package according to claim 1, wherein said cavity containing the product is rendered accessible upon pulling apart and releasing the releasable connections between said first and second packaging material elements.

32. A non-reclosable package for products which are prejudicial to health, said packaging comprising:

a first packaging material element;

a second packaging material element, wherein said first and second packaging material elements are arranged so a to lie on top of each other; at least one first surface section having at least one margin, wherein said first and second packaging material elements are releasably connected with each other at said at least one margin of said at least one surface section for forming at least one cavity in said package, wherein said at least one cavity is enclosed on all sides, receives the product to be packaged, and is formed between said first packaging material element and said second packaging material element;

at least one unsealed, second surface section which lies outside said at least one first surface section or adjoins said at least one first surface section, said at least one second surface section being delimited by at least one margin, wherein said first packaging material element and said second packaging material element are releasably connected with each other by releasable connections at said at least one margin of at said at least one second surface section; and wherein at least one structure is present in at least one of said packaging material elements, said at least one structure being selected from the group of structures consisting of straight cuts, jagged cuts, undulated cuts, perforations, recesses in material, punchings and predetermined breaking points; and wherein said at least structure extends within said at least one second surface section and enables said first packaging material element and said second packaging material element to be torn in a tear-open direction, and at least one crease line or fold line which at least partially extends within the second surface section and extends through said first surface section, and wherein said at least one structure intersects the crease line or fold line.

33. A non-reclosable package for products which are prejudicial to health, said package comprising:

a first packaging ,material element;

a second packaging material element, wherein said first and second packaging material elements are arranged so as to lie on top of each other; at least one first surface section having at least one margin, wherein said first and second packaging material elements are releasably connected with each other at said at least one margin of said at least one surface section for forming at least one cavity in said package, wherein said at least one cavity is enclosed on all sides, receives the product to be packaged, and is formed between said first packaging material element and said second packaging material element;

at least one unsealed, second surface section which lies outside said at least one first surface section or adjoins said at least one first surface section, said at least one second surface section being delimited by at least one margin, wherein said first packaging material element and said second packaging material element are releasably connected with each other by releasable connections at said at least one margin of said at least one second surface section; and wherein at least one structure is present in at least one of said packaging material elements, said at least one structure being selected from the group of structures consisting of straight cuts, jagged cuts, perforations, recesses in material, punchings and predetermined breaking points; and wherein said at least one structure extends within said at least one second surface section and enables said first packaging material element and said second packaging material element to be torn in a tear-open direction, and at least one crease line or fold line which at least partially extends at an outer edge of said second surface section and extends through the margin at or near said first surface section, and wherein said at least one structure intersects the crease line or fold line.

34. A process for manufacturing a package and for Packaging objects, said process comprising the following steps:

providing a first packaging material element;

providing a second packaging material element;

positioning the product to be packaged on one of the two packaging material elements;

superimposing and connecting said first packaging material element and said second packaging material element for forming at least one first surface section having at least one margin, wherein said first packaging material element and said second packaging material element are releasably connected with each other at said at least one margin of said at least one first surface section, and for forming at least one cavity between said first packaging material element and said second packaging material element, said at least one cavity being enclosed on all sides and receives the product to be packaged, and for forming at least one unsealed, second surface section which lies outside said at least one first surface section or adjoins said at least one first surface section, and wherein said first packaging material element and said second packaging material element are releasably connected to each other at said at least one margin of said at least one first surface section; and providing at least one structure in at least one of the two packaging material elements, wherein said at least one structure extends within the at least one second surface section and enables said first packaging material element and said second packaging material element to be torn in a tear-open direction, and comprising the step of forming at least one crease line or fold line which at least partially extends within the second surface section or at an outer edge of said second surface section and extends through said first surface section or into the sealed margin area at or near said first surface section, and wherein said at least one structure intersects the crease line or fold line.

35. The process according to claim 34, further comprising the step of utilizing a peelable seal lacquer to form sealed seams or sealed surfaces for connecting said first packaging material element and said second packaging material element with one another.

36. The process according to claim 34, wherein said at least one structure comprises multiple structures, further comprising the step of providing said first packaging material element and said second packaging material element with said multiple structures, wherein said at least one structure are multiple structures being alike or similar and are arranged to be congruent to one another.

37. The process according to claim 34, wherein said at least one structure is selected from the following group of structures consisting of straight cuts, jagged cuts, undulated cuts, perforations, recesses in the material, punchings, and predetermined breaking points.

38. The process according to claim 34, wherein said at least one structure is arranged within said at least one first surface section or said at least one second surface section near the margin but not within the margin which connects said first packaging material element and said second packaging material element.

39. The process according to claim 34, wherein said first packaging material element and said second packaging material element is produced in the form of a bag which is closed all around.

40. The process according to claim 34, wherein said second packaging material element is selected from the group consisting of containers, hollow bodies, and deep-drawn moulded parts.

41. The process according to claim 34, further comprising the step of releasably connecting the margins of said first packaging material element and said second packaging material element with one another at least two edges by sealed seams.

42. The process according to claim 34, comprising the step of connecting said first packaging material element and said second packaging material element along the entire outer margin of the package by an uninterrupted sealed layer.

43. The process according to claim 34, further comprising the step of providing said at least one structure intersecting the crease line or fold line at right angles.

44. The process according to claim 37, wherein said perforations comprise at least one of dots and cuts arranged one after another, and said punchings are selected from the group consisting of arrow-shaped, triangular-shaped and rhombic-shaped punchings.

45. The process according to claim 40, wherein said hollow bodies are bottles.

46. The process according to claim 41, further comprising the step of releasably connecting the margins of said first packaging material element and said second packaging material element with one another by sealed seams at least three edges.

* * * * *

UNITED STATES PATENT AND TRADEMARK OFFICE

CERTIFICATE OF CORRECTION

PATENT NO. : 8,307,983 B2
APPLICATION NO. : 11/664243
DATED : November 13, 2012
INVENTOR(S) : Karin Ludwig and Michael Horstmann It is certified that error appears in the above-identified patent and that said Letters Patent is hereby corrected as shown below:

Cover sheet, item 22, after "PCT Filed:" delete "Oct. 9, 2005" and enter -- Sept. 10, 2005 --

Signed and Sealed this
Fifth Day of February, 2013

Teresa Stanek Rea
*Acting Director of the United States Patent and Trademark Office*